US006095870A

United States Patent [19]

Lee

[11] Patent Number: 6,095,870

[45] Date of Patent: Aug. 1, 2000

[54] FAULT PREVENTING STRUCTURE FOR ENGAGEMENT OF A TERMINAL SEAT

[76] Inventor: Shou An Lee, 5F-5, No. 1, Sec. 2, Hsin I Road, Taipei, Taiwan

[21] Appl. No.: 09/150,031

[22] Filed: Sep. 9, 1998

[51] Int. Cl.[7] ..... H01R 13/645

[52] U.S. Cl. ..... 439/681

[58] Field of Search ..... 439/677, 680, 439/681, 701

[56] References Cited

U.S. PATENT DOCUMENTS

| | | | |
|---|---|---|---|
| 3,656,086 | 4/1972 | Debaigt | 439/681 |
| 4,350,409 | 9/1982 | Kato et al. | 439/681 |
| 4,772,227 | 9/1988 | Pelzl et al. | 439/681 |
| 4,813,892 | 3/1989 | Strate | 439/681 |
| 5,254,019 | 10/1993 | Noschese | 439/681 |

*Primary Examiner*—Hien Vu
*Attorney, Agent, or Firm*—Rosenberg, Klein & Lee

[57] ABSTRACT

A structure for preventing false engagement of a connecting seat with a base is disclosed, in which one or more stoppers in different positions are installed in spacing sections between each of the two adjacent jacks, at the top ends of the spacing sections of the base. Longitudinal notches corresponding to the stoppers are formed on the top edge of the spacers that separate respective pairs of the plurality of receiving holes of the connecting seat. When the base and the connecting seat are to be engaged, if the stopper is aligned with the notch, they can be engaged tightly. If it is not aligned with the notch, the connecting seat and base can not be engaged.

1 Claim, 4 Drawing Sheets

FAULT PREVENTING STRUCTURE FOR ENGAGEMENT OF A TERMINAL SEAT

BACKGROUND OF THE INVENTION

1. Field of the Invention

The present invention relates to a fault preventing structure for engagement of a terminal seat, especially to a fault preventing structure in which by the alignment of the stopper and the notch to prevent the fault engagement.

2. Background of the Invention

As shown in FIG. 1, a prior art terminal seat has a base (1) and a connecting seat (2). The base has one or more parallel jacks (11) and elastic pieces (111) are installed within the jacks (11). The connecting seat (2) is installed with receiving holes (21) with the respective number of the jacks in base and a conducting piece (211) is installed in each of the receiving holes (21) so that after the base (1) and the connecting seat (2) have been engaged with each other, by the connecting seat (211) being inserted into the elastic piece (211), the conduction effect is achieved. However, since this kind of terminal seats have the same structure, thus fault engagements are often occurred.

Therefore, a fault preventing structure has been disclosed, which are formed by a thin pieces (12) and hooks (22), and the thin pieces (12) with different numbers are embedded into the sliding groove (112) above the jacks (11) of the base (1). The hooks (22) is hooked on the top portions of the receiving holes (21) of the connecting seat (2) in different positions. Therefore, the base (1) and the connecting seat (2) with thin pieces (12) and hooks (22) on the same positions can not joint successfully, since the hooks are stopped by the thin pieces (12). However, this kind structure is not easy to be finished, and the hooks (22) engaged on the receiving holes (21) of the connecting seat 92) are easy to drop, another, gaps are easy to be formed in the terminal seat since the thickness of the hooks (22), so it can not be engaged completely.

SUMMARY OF THE INVENTION

Accordingly, the object of the present invention is to provide a fault preventing structure for engagement of a terminal seat, in which one or more stoppers in different positions are installed between each of the two adjacent jacks on the top end of the spacers in the jacks of base, and longitudinal notches with respective to the stoppers of the base is installed on the top edge of the spacers of the plurality of receiving holes so that when the base and the connecting seat are to be engaged, if the stopper is aligned with the notch, they can be engaged tightly; if it is not aligned with the notch, they can not be engaged, therefore, the effect of preventing fault engagement is achieved.

Another object of the present invention is to provide a fault preventing structure for engagement of a terminal seat, in which by the engagement of the stopper and the notch, when the base and the connecting seat are tightly engaged with each other, there is no any gap therebetween.

The present invention will be better understood and its numerous objects and advantages will become apparent to those skilled in the art by referencing to the following drawings in which:

DETAILED DESCRIPTION OF THE PREFERRED EMBODIMENT

Figure 1:
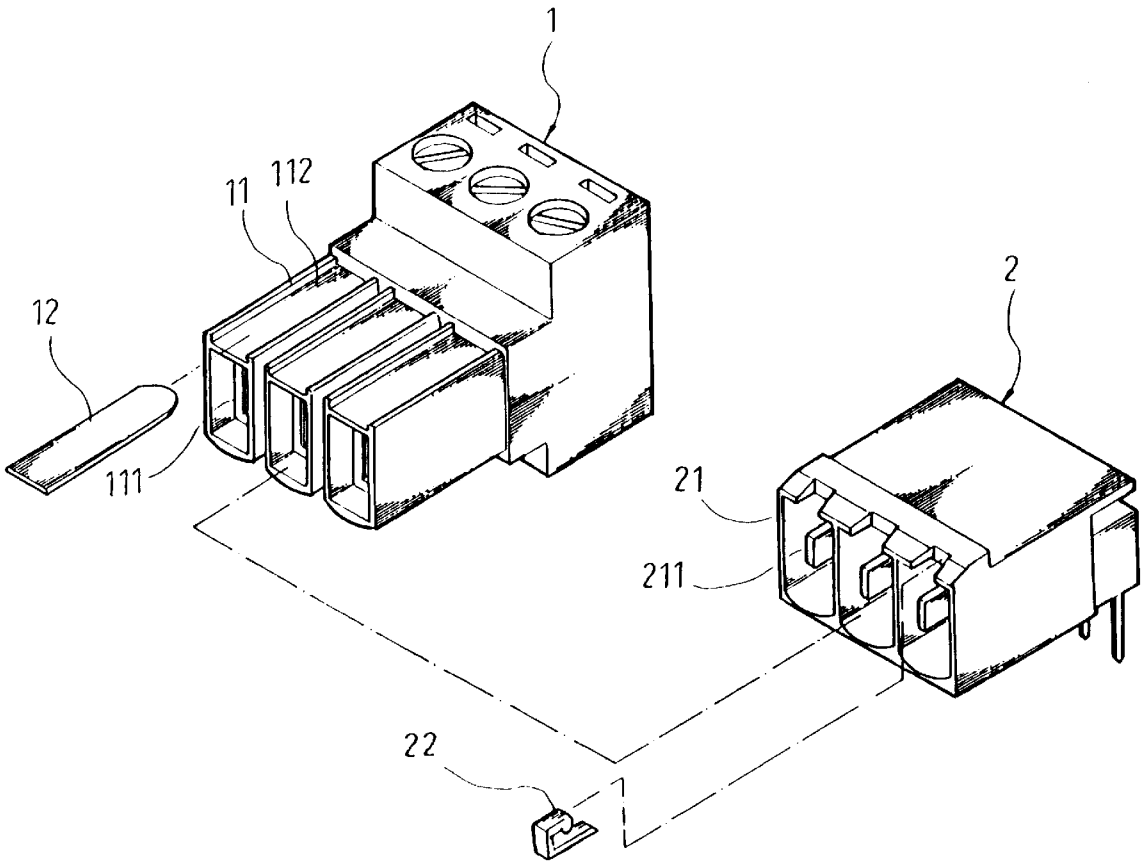
FIG.1 PRIOR ART
FIG. 1 is a perspective view of a prior art terminal seat.
Figure 2:
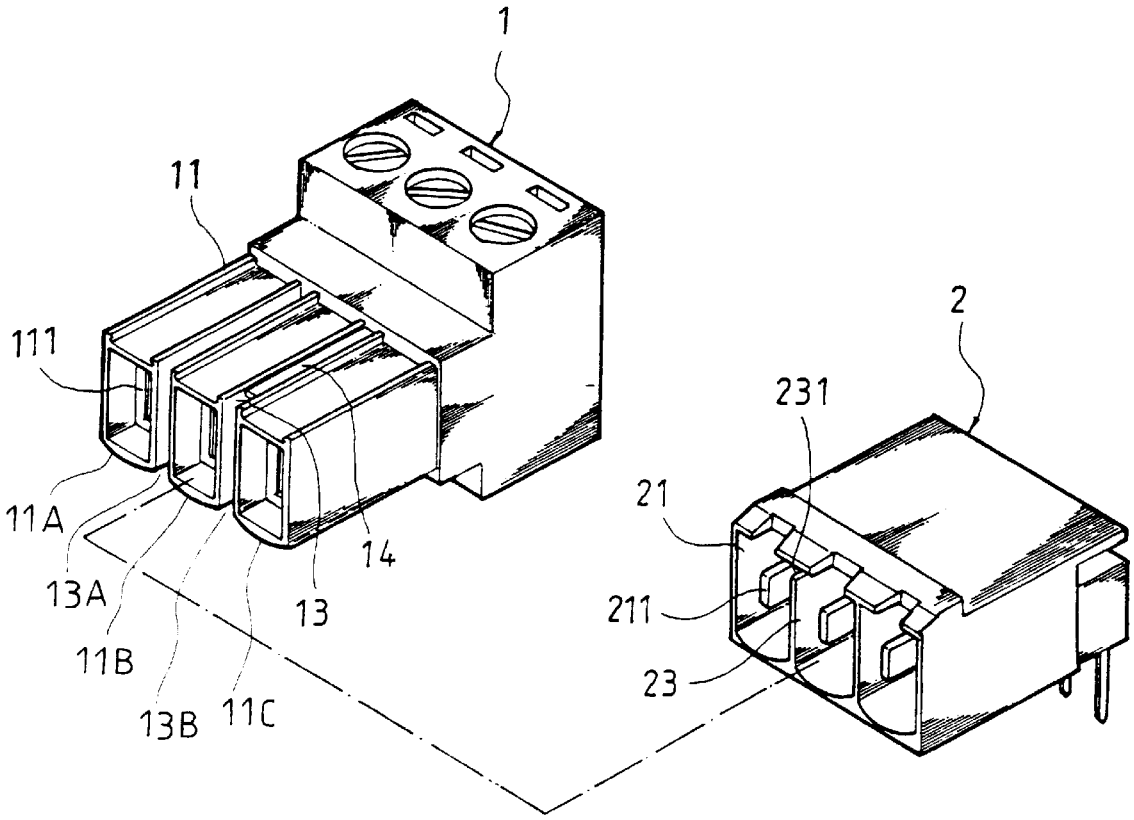
FIG. 2 is a schematic view of the present invention.

Referring to FIG. 2, the terminal seat of the present invention is installed with a base (1) and a connecting seat (2) as in the prior art. Similarly, the base (1) is installed with a plurality of jacks (11) and elastic piece (111) for clamping is installed within each of the jacks, wherein in the upper end of the spacing section (13) of the jack (11), stoppers (14) are installed between adjacent jacks (11) (for example, three jacks (11), (11A) and (11B) are installed between the spacing sections (13), (13A) and (13B)).

As the prior art terminal seat, the connecting seat (2) is installed with a plurality of receiving holes (21) inside of which are installed with conducting pieces (21), wherein longitudinal notches (231) with respective to the stoppers (14) of the base are installed on the top edges of the spacers (23) of the plurality of receiving holes (21) so that when the base (1) and the connecting seat (2) are to be engaged, if the stopper (14) is not aligned with the notch (231), they can not be engaged, therefore, the effect of preventing fault engagement is achieved.

Figure 3:
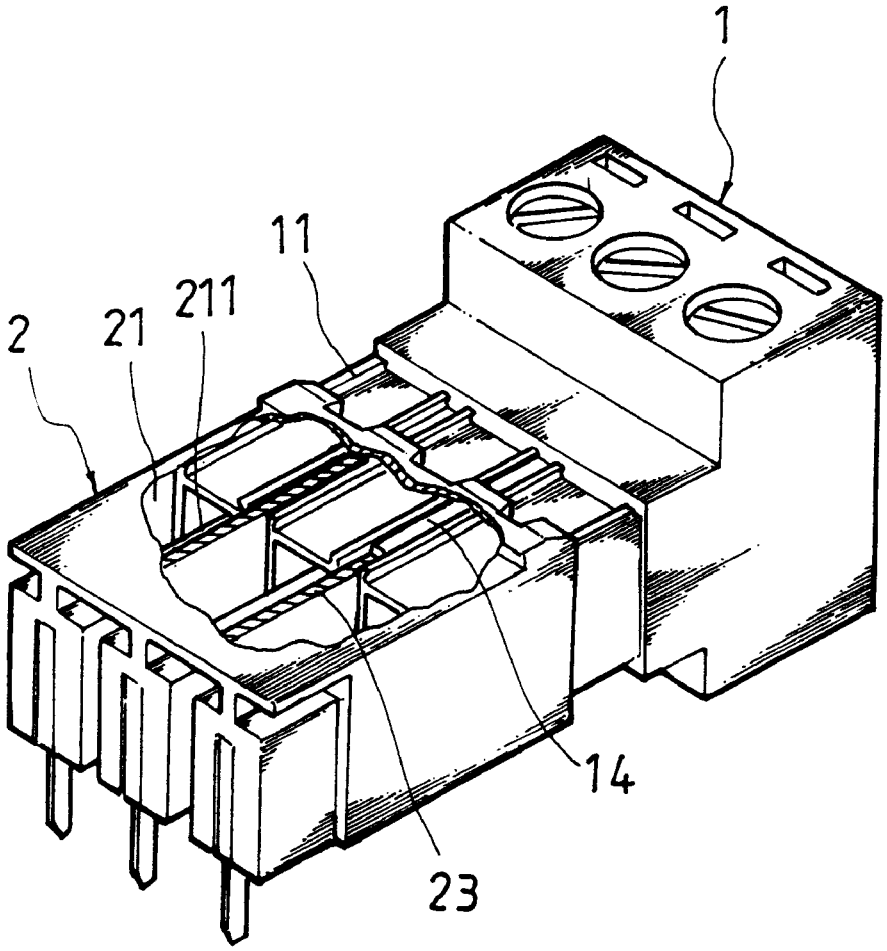
FIGS. 3 and 4 are a schematic view of the embodiment of the present invention.

Referring to FIG. 3, in using the present invention, the jack of the base is jointed with the receiving hole (21) of the connecting seat (2) so that the conducting piece (211) of the connecting seat (2) is inserted into the elastic piece (111) of the base (1), thus the conducting effect is achieved. While when the stopper (14) of the base (1) is correctly aligned with the notch (231) of the connecting seat (2), the stopper (14) will slide into the notches (231) so that the base (1) and the connecting seat (2) may be engaged successfully.

Figure 4:
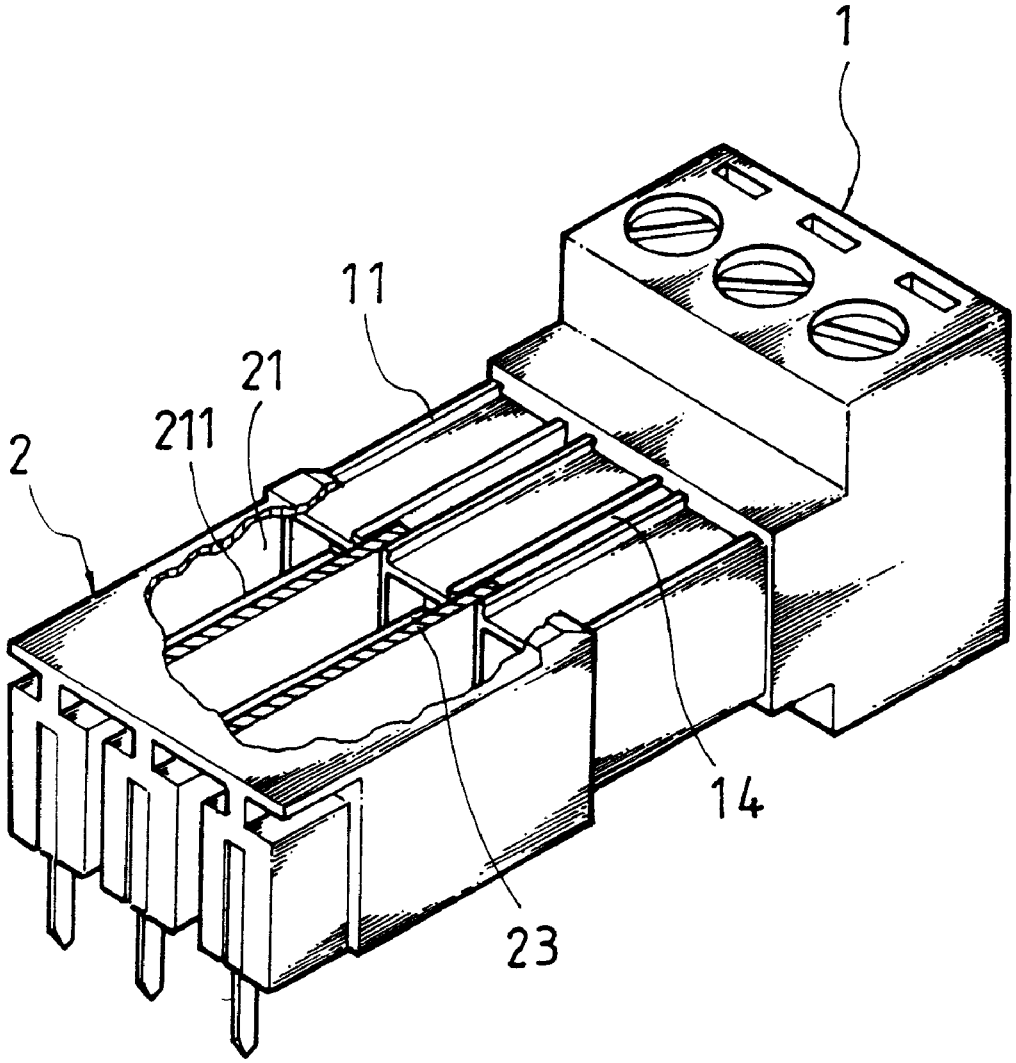

As shown in FIG. 4, when stoppers (14) and notches (231) of the base (1) and the connecting seat (2), respective, are not correctly aligned, since the spacers (23) of the connecting seat (2) are stopped by the stoppers (14) of the base (1). Thus the base (1) and the connecting seat (2) will not be engaged with each other. In consequence, the effect of preventing fault engagement is achieved.

In summary, in the present invention, by the stoppers and notches of the base and the connecting seat, respective, the effect of preventing fault engagement is achieved Not only the different signals may be transferred in right way, but also the assembly is more easy without using eyes of the worker.

Although certain preferred embodiment of the present invention has been shown and described in detail, it should be understood that various changes and modification may be made therein without departing from the scope of the appended claims.

What is claimed is:

1. An electrical connector structure for preventing false engagement, comprising:

a base, said base including (a) a plurality of D-shaped jacks extending therefrom, each of said jacks having a clamping elastic member therein, (b) a plurality of spacing sections respectively located between adjacent pairs of said plurality of said D-shaped jacks, and (c) at least one elongated stopper member located in an upper portion of at least one of said plurality of spacing sections; and, a connecting seat for coupling with said base, said connecting seat including a plurality of receiving D-shaped holes corresponding to said plurality of said, D-shaped jacks and a plurality of spacers respectively disposed between adjacent pairs of said receiving holes, each of said receiving holes having a conducting member disposed therein, at least one of said spacers having a longitudinal notch formed in an upper end thereof, said connecting seat being engageable with said base when said base is received in said connecting seat and said longitudinal notch of said at least one spacer is in correspondence with said at least one stopper and prevented from engagement when said longitudinal notch of said at least one spacer is in non-correspondence with said at least one stopper.

* * * * *